US005388599A

United States Patent [19]

Yen

[11] Patent Number: 5,388,599

[45] Date of Patent: Feb. 14, 1995

[54] RETRACTABLE TOOTHBRUSH AND TOOTHPASTE HOLDER

[76] Inventor: Lung W. Yen, 20-1 F, No. 204, 2nd Sec., Po-Ai Erh Rd., Sanmin District, Kaohsiung City, Taiwan, Prov. of China

[21] Appl. No.: 181,217

[22] Filed: Jan. 13, 1994

[51] Int. Cl.[6] ..... A46B 15/00

[52] U.S. Cl. ..... 132/311; 132/308; 15/167.1

[58] Field of Search ..... 132/308, 310, 311, 286, 132/313; 15/167.1

[56] References Cited

U.S. PATENT DOCUMENTS

| | | | |
|---|---|---|---|
| 1,340,115 | 5/1920 | Breining | 132/311 |
| 2,476,686 | 7/1949 | Smith | 132/311 |
| 2,507,250 | 5/1950 | Eastin | 132/311 |
| 3,763,869 | 10/1973 | Sanders | 132/311 |

*Primary Examiner*—John G. Weiss
*Assistant Examiner*—Elise Speaks
*Attorney, Agent, or Firm*—Morton J. Rosenberg; David I. Klein

[57] ABSTRACT

The present invention relates to a retractable toothbrush and toothpaste holder which mainly consists of a cylinder assembly, a lifting member with a toothbrush and toothpaste tube attached thereto and being disposed inside the inner cylinder, and a rotating seat connected to a lower end of the cylinder assembly. Wherein, the cylinder assembly further consists of an inner cylinder and a sleeve being put over the inner cylinder, and the lifting member has two opposite tenons extending into two spiral grooves formed on an inner wall of the sleeve. When the rotating seat is rotated, the inner cylinder connected thereto is caused to turn, and the lifting member inside the inner cylinder is brought to move upward along the two spiral grooves of the sleeve, and thereby, enabling the toothbrush and the toothpaste tube attached to the lifting member to extend out of the cylinder assembly for use. Turn the rotating seat in reverse direction causes the lifting member, and the toothbrush and toothpaste tube, accordingly, to lower down into the cylinder assembly for convenient carrying. A hood may be covered over the retracted toothbrush holder to protect the same, or be removed to be used as a water container for using in tooth brushing.

3 Claims, 4 Drawing Sheets

RETRACTABLE TOOTHBRUSH AND TOOTHPASTE HOLDER

BACKGROUND OF THE INVENTION

The presently commercially available toothbrush and toothpaste are not convenient in carrying for use outdoors or in offices even though they do not occupy too much room. Moreover, when a toothbrush and/or toothpaste are carried by putting them in a pocket or hand bag, the hair of toothbrush is frequently deformed or contaminated by dirt or impurities in the pocket or hand bag, and the toothpaste may undesirably smudge clothes or bag or other articles in the same pocket or hand bag due to loosened cap thereof. That is why most people do not want to take a toothbrush or toothpaste with them when they are out. As a result, when dining out, such as on a picnic, in office, or in school, food residue left between teeth can not be immediately cleared.

It is therefore desirable to develop a toothbrush and toothpaste holder which can eliminate the drawbacks existed in the conventional toothbrush and toothpaste and enable the same to be conveniently carried for use at any place.

SUMMARY OF THE INVENTION

The present invention relates to a retractable toothbrush and toothpaste holder which mainly consists of a cylinder assembly, a lifting member with a toothbrush and toothpaste tube attached thereto and being disposed inside the inner cylinder, and a rotating seat connected to a lower end of the cylinder assembly. Wherein, the cylinder assembly further consists of an inner cylinder and a sleeve being put over the inner cylinder, and the lifting member has two opposite tenons extending into two spiral grooves formed on an inner wall of the sleeve. When the rotating seat is rotated, the inner cylinder connected thereto is caused to turn, and the lifting member inside the inner cylinder is brought to move upward along the two spiral grooves of the sleeve, and thereby, enabling the toothbrush and the toothpaste tube attached to the lifting member to extend out of the cylinder assembly for use. Turn the rotating seat in reverse direction causes the lifting member, and the toothbrush and toothpaste tube, accordingly, to lower down into the cylinder assembly for convenient carrying. A hood may be covered over the retracted toothbrush holder to protect the same, or be removed to be used as a water container for use in tooth brushing.

DETAILED DESCRIPTION OF THE PREFERRED EMBODIMENT

Figure 1:
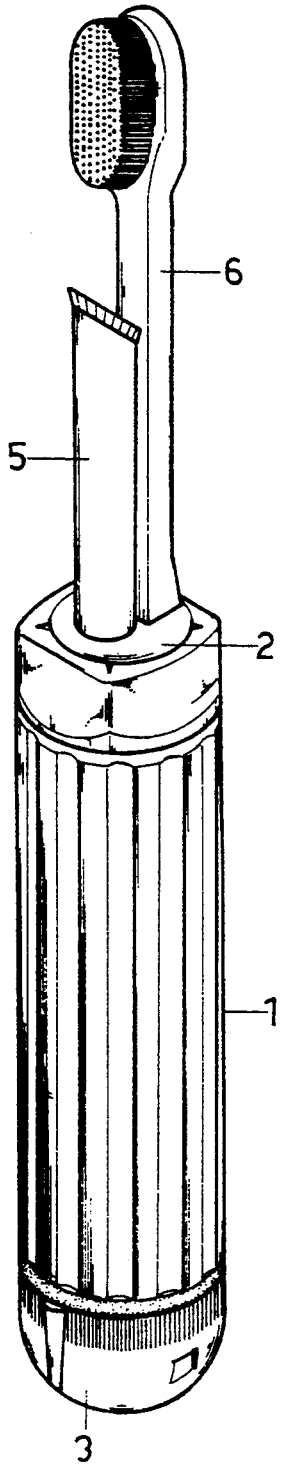
FIG. 1 is a perspective of the retractable toothbrush and toothpaste holder of the present invention in an extended position.

Please refer to FIG. 1. The present invention relates to a retractable toothbrush and toothpaste holder which mainly includes a cylinder assembly 1, a lifting member 2 having means for receiving a toothpaste tube 5 and a toothbrush 6, and a rotating seat 3.

Figure 2:
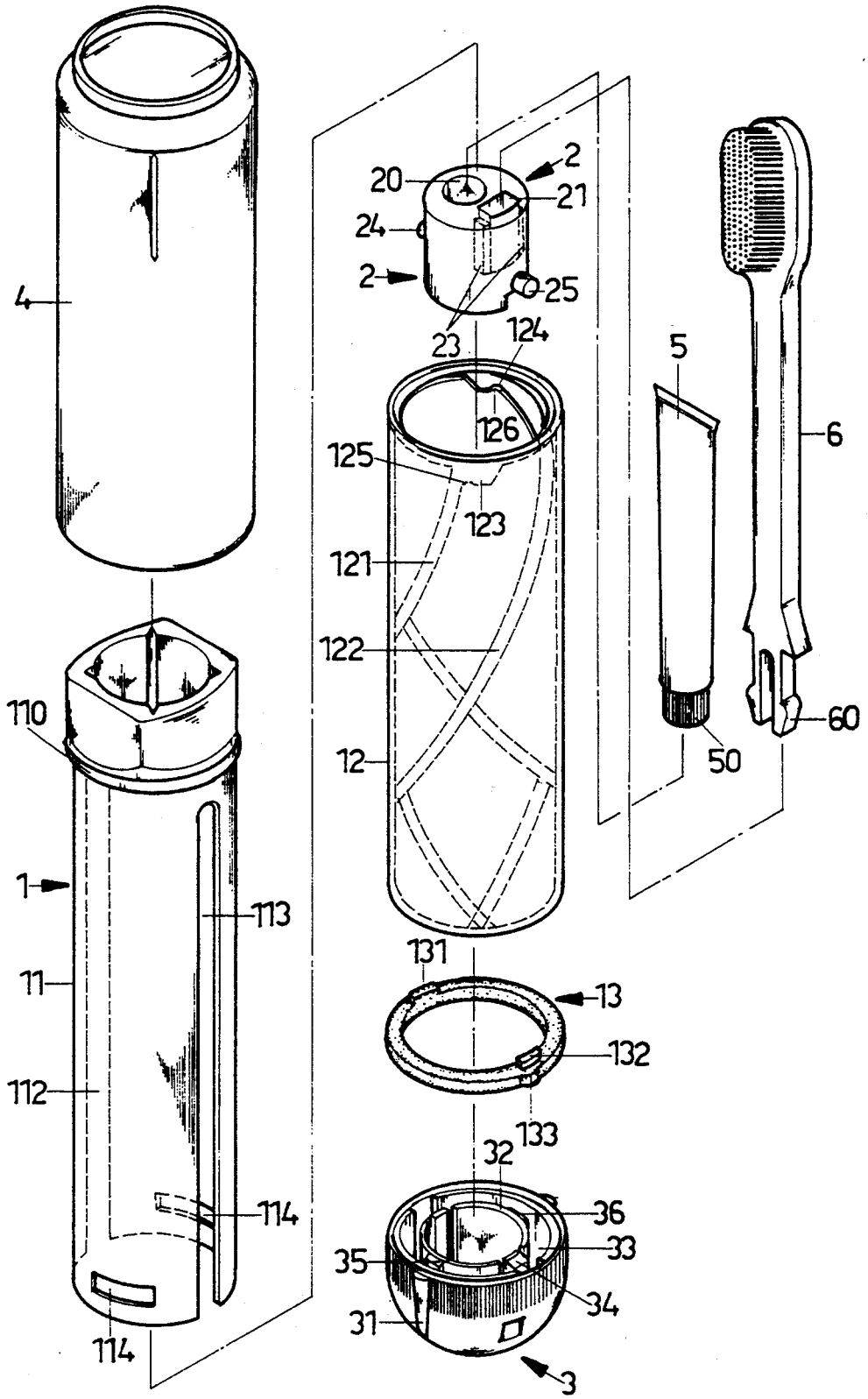
FIG. 2 is an exploded perspective of the retractable toothbrush and toothpaste holder according to the present invention.

Please refer to FIG. 2. The cylinder assembly 1 mainly consists of an inner cylinder 11 and a sleeve 12. The inner cylinder 11 is received in the sleeve 12 and is slightly longer than the sleeve 12. The inner cylinder 11 is a substantially hollow tube having a circle of outer collar 110 provided near a top end thereof, two elongated guiding grooves 112, 113 oppositely provided at the wall of the cylinder 11 and extending from a lower edge of the cylinder 11 upward to a point below the collar 110, and two slots 114 oppositely provided on the wall of the cylinder 11 near the lower edge thereof and each being located between the two guiding grooves 112, 113. The sleeve 12 is also a hollow tube having an outer diameter substantially equal to that of the collar 110 of the inner cylinder 11, such that a top edge of the sleeve 12 is stopped at a lower edge of the collar 110 when the cylinder 11 is disposed into the sleeve 12 from a top end thereof. The sleeve 12 is provided on its inner wall surface two spiral grooves 121, 122 each of which extends from a point on a lower edge of the sleeve 12 corresponding to one of the guiding groove 112, 113 upward to the top end of the sleeve 12 and then turns into a horizontally extended mortise 123, 124 each of which has a retaining bosses 125, 126 formed at a start point thereof. A retaining ring 13 having two ribs 131, 132 oppositely provided on its upper surface and a locking point 133 circumferential provided at a predetermined position is engaged with the sleeve 12 at a lower edge thereof. The lifting member 2 is basically a short cylinder having a top surface on which a round hole 20 and a retaining recess 21 are formed for receiving a cap 50 of a small size toothpaste tube 5 and a rear end of a toothbrush 6, respectively. The retaining recess 21 has two side ear portions 23, and the toothbrush 6 is specially designed to have a forked rear end with two prongs each of which has a retaining boss 60 formed at an outer side thereof, such that when the toothbrush 6 is inserted into the retaining recess 21, the retaining bosses 60 on the two rear prongs shall extend into the two ear portions 23 of the retaining recess 21 and thereby enable the toothbrush 6 to be firmly held on the lifting member 2. The lifting member 2 also has two tenons 24, 25 oppositely provided on the circumferential surface thereof. The lifting member 2 is disposed in the inner cylinder 11 with the two tenons 24, 25 extending into the guiding grooves 112, 113, respectively, and further engaging with the spiral grooves 121, 122 of the sleeve 12.

The rotating seat 3 is a substantially hollow bowl-like member. A locating mark 31 is provided on the outer surface of the rotating seat 3 at a predetermined position. A circle of partition 32 is provided inside the rotating seat 3 so that an annular recess 33 is formed between the partition 32 and the wall of the rotating seat 3 to fitly receive the lower edge of the inner cylinder 11. The partition 32 is provided with two opposite hook members 34 and two opposite locating bars 35, 36 at predetermined positions while both the hook members and the locating bars project into the annular recess 33. The hook members 34 extend into and are restrained in the two slots 114 near the lower edge of the inner cylinder 11. The locating bars 35, 36 are corresponding to and extend into the guiding grooves 112, 113 of the inner cylinder 11.

Figure 3:
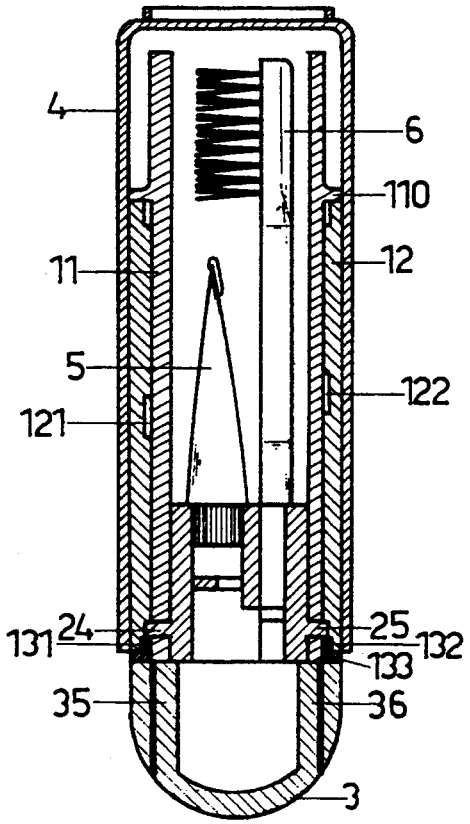
FIG. 3 is an exposed view showing the retractable toothbrush and toothpaste holder of the present invention with the toothbrush and toothpaste received in the holder.

Please refer to FIGS. 2 and 3. To assemble the toothbrush and toothpaste holder of the present invention, first put the inner cylinder 11 into the sleeve 12 from the top end thereof with the collar 110 of the inner cylinder 11 bearing against the upper end of the sleeve 12, this will permit the lower edge of the inner cylinder 11 to extend out of the lower edge of the sleeve 12, and then, turn the inner cylinder 11 until the guiding grooves 112, 113 thereof meet the starting point of the spiral grooves 121, 122 of the sleeve 12. Put the lifting member 2 with a toothpaste tube 5 and a toothbrush 6 inserted therein in the inner cylinder 11 with the two tenons 24, 25 projecting out of the two guiding grooves 112, 113 to engage with the two spiral grooves 121, 122, respectively. Put the retaining ring 13 over the inner cylinder 11 from its lower edge with the ribs 131, 132 extending upward into the staring points of the two spiral grooves 121, 122, respectively. Then, connect the rotating seat 3 to the inner cylinder 11 by engaging the lower edge of the inner cylinder 11 with the annular recess 33 of the rotating seat 3 with the two locating bars 35, 36 projecting out of the two guiding grooves 112, 113 of the inner cylinder 11. Finally, push the rotating seat 3 against the inner cylinder 11 until the two hook members 34 of the rotating seat 3 extend into and are retained by the two slots 114 of the inner cylinder 11.

An additional cylindrical hood 4 may be covered to the cylinder assembly 1 to protect the retracted toothbrush 6 and toothpaste tube 5 from being contaminated, and be used as a water container when necessary. What is to be noted is that the positions of the guiding grooves 112, 113 of the inner cylinder 11 respectively correspond to that of the spiral grooves 121, 122 of the sleeve 12, of the tenons 24, 25 of the lifting member 2, of the ribs 131, 132 of the retaining ring 13, and of the locating bars 35, 36 of the rotating seat 3; and, to facilitate the assembling of the present invention, the guiding grooves 112, 113, the spiral grooves 121, 122, the tenons 24, 25, the ribs 131, 132, and the locating bars 35, 36 may be formed to have two groups of different sizes but keep the same corresponding relation with one another.

Figure 4:
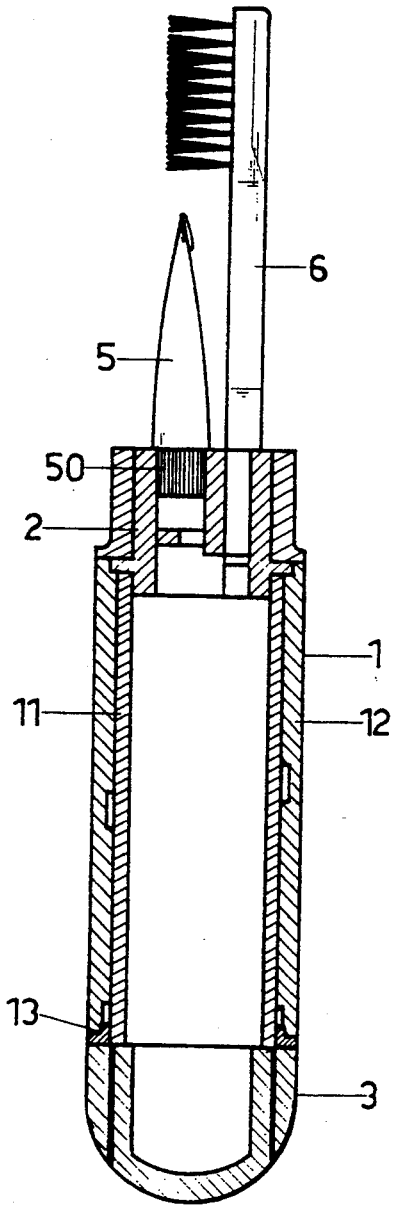
FIG. 4 is an exposed view showing the manner in which the rotating seat of the present invention is rotated to raise the toothbrush and toothpaste.

FIG. 3 illustrates the present invention in a retracted position with the toothbrush 6 and the toothpaste tube 5 being received inside the cylinder assembly 1. To extend the holder of the present invention for use, just remove the hood 4, grip the cylinder assembly 1 with one hand and turn the rotating seat 3 with the other hand (or, hold the rotating seat 3 with one hand and turn the sleeve 12 of the cylinder assembly 1 with the other hand). The turning of the rotating seat 3 causes the coupled inner cylinder 11 to rotate. At this point, the lifting member 2 in the inner cylinder 11 is brought to turn, too. Since the tenons 24, 25 of the lifting member 2 extend through the guiding grooves 112, 113 of the inner cylinder 11 and into the spiral grooves 121, 122 of the sleeve 12, the lifting member 2 is brought to move upward along the inclined surface of the spiral grooves 121, 122. When the tenons 24, 25 are moved to the top end of the spiral grooves 121, 122, the toothbrush 6 and the toothpaste tube 5 on the lifting member 2 are now completely extended out of the cylinder assembly 1, as shown in FIG. 4. When the rotating seat 3 is further rotated, the tenons 24, 25 shall be forced to pass the retaining bosses 125, 126 (not shown) and enter into the horizontally extended mortises 123, 124 formed at the top end of the spiral grooves 121, 122. Due to the termination of the inclined surface of the spiral grooves 121, 122, the lifting member 2 is no longer moved upward and the tenons 24, 25 are confined in the horizontal mortises 123, 124 by the bosses 125, 126, respectively. When the toothbrush 6 and the toothpaste tube 5 are completely extended out of the cylinder assembly 1 and are retained in place, the locking point 133 on the retaining ring 13 shall engage with the locating mark 31 of the rotating seat 3 so that the completely lifted position of the lifting member 2 may be easily identified.

When the toothbrush 6 and the toothpaste tube 5 are to be retracted back to the cylinder assembly 1, simply rotate the rotating seat 3 in reverse direction, and the lifting member 2 shall descend along the inclined surface of the spiral grooves 121, 122 within the inner cylinder 11 until the toothbrush 6 and the toothpaste tube 5 are completely retracted back to the cylinder assembly 1.

What is claimed is:

1. A retractable toothbrush and toothpaste holder, comprising a cylinder assembly, a lifting member with a toothbrush and toothpaste tube attached thereto, and a rotating seat; said cylinder assembly consisting of a through inner cylinder and a sleeve, said sleeve being shorter than said inner cylinder and covering said inner cylinder; said inner cylinder having a collar near a top end bearing against a top edge of said sleeve, two equilength elongated guiding grooves oppositely formed on a wall of said inner cylinder, extending from a lower edge of said inner cylinder upward to a point below said collar, and two slots formed near said lower edge of said inner cylinder and each said slot being located between said two guiding grooves; said sleeve having an inner wall on which two spiral grooves are located, each said spiral groove having a starting point at a lower edge of said sleeve corresponding to one of said guiding grooves of said inner cylinder; said spiral grooves each extending upward to said top edge of said sleeve and turning to a horizontally extending mortise, said horizontal mortises each having a retaining boss formed at an entrance to said mortise; said lifting member having a top surface in which a round hole and a retaining recess are formed therein, said round hole receives said toothpaste tube, and said retaining recess receives a rear end of said toothbrush, and two tenons being oppositely provided on a circumferential surface of said lifting member near a lower edge thereof; said lifting member being disposed inside said inner cylinder at a lower portion thereof with said two tenons extending out of said two guiding grooves of said inner cylinder and separately engaging with said starting points of said two spiral grooves; said rotating seat comprising an outer circumferential wall and an inner circular partition wherein an annular recess is formed between said wall and said partition, said annular recess receiving said lower edge of said inner cylinder; said partition comprising two opposite hook members and two opposite locating bars, each said bar being provided at a predetermined position between said two hook members, both of said hook members and locating bars projecting into said annular recess; said lower edge of said inner cylinder engaging with said annular recess of said rotating seat, said two locating bars separately engaging with said two guiding grooves of said inner cylinder, and said two hook members extending into and retained by said two slots at said lower edge of said inner cylinder, such that when said rotating seat is rotated, said inner cylinder will rotate also, said lifting member moves upward along an inclined surface of said spiral grooves until said two tenons of said lifting member enter into said horizontally extended mortises.

2. A retractable toothbrush and toothpaste holder as claimed in claim 1, wherein said retaining recess comprises two opposite ear portions; said toothbrush attached to said lifting member has a forked rear end with two prongs, each said prong having a boss at an outer side thereof, such that said toothbrush is firmly disposed in said retaining recess and retained by said bosses in said ear portions.

3. A retractable toothbrush and toothpaste holder as claimed in claim 1, wherein said cylinder assembly comprises a retaining ring having two ribs provided at a top surface thereof, each said rib at a position corresponding to one of said guiding grooves and received in one of said starting points of said spiral grooves, and a locking point provided on a circumferential surface of said retaining ring at a position corresponding to a locating mark formed at an outer surface of said rotating seat whereby an engagement of said locking point with said locating mark facilitates the identification of a completely ascended position of said lifting member.

* * * * *